US009809957B2

(12) United States Patent
Rösth

(10) Patent No.: US 9,809,957 B2
(45) Date of Patent: Nov. 7, 2017

(54) ENERGY RECOVERY METHOD AND SYSTEM

(75) Inventor: Marcus Rösth, Boräs (SE)

(73) Assignee: Parker Hannifin AB, Boras (SE)

( * ) Notice: Subject to any disclaimer, the term of this patent is extended or adjusted under 35 U.S.C. 154(b) by 379 days.

(21) Appl. No.: 14/122,027

(22) PCT Filed: May 23, 2011

(86) PCT No.: PCT/SE2011/050641

§ 371 (c)(1),
(2), (4) Date: Jan. 10, 2014

(87) PCT Pub. No.: WO2012/161628

PCT Pub. Date: Nov. 29, 2012

(65) Prior Publication Data

US 2014/0123633 A1 May 8, 2014

(51) Int. Cl.
*F15B 1/033* (2006.01)
*E02F 9/22* (2006.01)
(Continued)

(52) U.S. Cl.
CPC ..... *E02F 9/2217* (2013.01); *E02F 9/2296* (2013.01); *F15B 1/024* (2013.01); *F15B 1/033* (2013.01); *F15B 21/14* (2013.01); *F15B 2211/20546* (2013.01); *F15B 2211/20569* (2013.01); *F15B 2211/212* (2013.01); *F15B 2211/30575* (2013.01); *F15B 2211/31* (2013.01); *F15B 2211/327* (2013.01); *F15B 2211/6346* (2013.01); *F15B 2211/7053* (2013.01); *F15B 2211/761* (2013.01); *F15B 2211/88* (2013.01)

(58) Field of Classification Search
CPC ..... F15B 2211/88; F15B 2211/8609; F15B 2013/006
See application file for complete search history.

(56) References Cited

U.S. PATENT DOCUMENTS 3,971,215 A * 7/1976 Baron ..... E02F 3/30 37/396
5,116,188 A * 5/1992 Kurohashi ..... F16F 9/56 414/685

(Continued)

FOREIGN PATENT DOCUMENTS

DE 4000185 A1 7/1990
JP 59170505 A 9/1984

(Continued)

*Primary Examiner* — Thomas E Lazo
*Assistant Examiner* — Matthew Wiblin
(74) *Attorney, Agent, or Firm* — Renner, Otto, Boisselle & Sklar, LLP

(57) ABSTRACT

The object of the present invention is to provide an inventive energy recovery method for a hydraulic system comprising a hydraulic cylinder (1), a pump (2), a tank (3), a supply conduit (4), a return conduit (5), and a hydraulic accumulator (7), the method comprises the steps of charging said hydraulic accumulator (7), and storing fluid in said hydraulic accumulator (7), wherein said energy recovery method comprises the step of directing fluid from said hydraulic accumulator (7) into an expanding chamber (8, 9) of said hydraulic cylinder (1) during an overrunning load condition.

15 Claims, 3 Drawing Sheets

(51) Int. Cl.
*F15B 21/14* (2006.01)
*F15B 1/02* (2006.01)

(56) References Cited

U.S. PATENT DOCUMENTS

| | | | | |
|---|---|---|---|---|
| 6,467,264 | B1 * | 10/2002 | Stephenson | F15B 11/006 60/368 |
| 6,502,393 | B1 * | 1/2003 | Stephenson | F15B 11/006 60/414 |
| 6,962,050 | B2 | 11/2005 | Hiraki et al. | |
| 7,703,478 | B2 * | 4/2010 | Steinborn | F15B 11/006 137/596.17 |
| 8,683,793 | B2 * | 4/2014 | Bergstrom | E02F 9/2217 60/414 |
| 2004/0107699 | A1 | 6/2004 | Fales et al. | |
| 2007/0074509 | A1 * | 4/2007 | Zhang | E02F 9/2217 60/414 |
| 2008/0072589 | A1 | 3/2008 | Jacobs et al. | |
| 2008/0110165 | A1 | 5/2008 | Hamkins et al. | |
| 2011/0030364 | A1 | 2/2011 | Persson et al. | |

FOREIGN PATENT DOCUMENTS

| | | | |
|---|---|---|---|
| JP | 2011220390 | A | 11/2011 |
| WO | 9300515 | A1 | 1/1993 |

* cited by examiner

ENERGY RECOVERY METHOD AND SYSTEM

The present application is a national stage application of International Patent Application No. PCT/SE2011/050641 filed May 23, 2011, the disclosure of which is expressly incorprated by reference.

TECHNICAL FIELD

The present invention relates to an energy recovery method for a hydraulic system comprising a hydraulic cylinder, a pump, a tank, a supply conduit, a return conduit, and a hydraulic accumulator, wherein the method comprises the steps of charging said hydraulic accumulator, and storing fluid in said hydraulic accumulator. The present invention further relates to a corresponding system.

BACKGROUND ART

Hydraulic systems are frequently used for powering construction machines, such an excavator, which has a boom assembly comprising a boom, an arm and a bucket pivotally coupled to each other. A hydraulic cylinder assembly is used control and operate the boom assembly, wherein the hydraulic cylinder assembly comprises a plurality of hydraulic cylinders, each having a piston therein which defines two chambers in the cylinder.

During powered extension and retraction of a hydraulic cylinder, pressurized fluid from a pump is usually applied by a valve assembly to one cylinder chamber and all the fluid exhausting from the other cylinder chamber flows through the valve assembly into a return conduit that leads to the system tank. Under some conditions, an external load or other force acting on the machine enables extension or retraction of the cylinder assembly without significant fluid pressure from the pump. This is often referred to as an overrunning load. In an excavator for example, when the bucket is filled with heavy material, the boom can be lowered by the force of gravity alone. To save energy, it is desirable to recover the energy of that exhausting fluid, instead of dissipating it in the valve assembly. Some prior hydraulic systems operate in several different operating modes, of which one for example is said powered extension and retraction, and another is an energy recovery mode, in which pressurised exhausting fluid from an hydraulic actuator is sent to an accumulator, where it is stored under pressure for later use in powering the machine. Prior art documents US 2008/0110165 and US 2007/0074509 shows examples of energy recovery systems using such accumulators. These prior art systems are however not optimized and further improvements with respect to energy saving are possible.

There is thus a need for an improved energy saving system for recovering and reusing energy in a hydraulic system.

SUMMARY

The object of the present invention is to provide an inventive energy recovery method where the previously mentioned problem is partly avoided. This object is achieved by the features of the characterising portion of claim 1, wherein said energy recovery method comprises the step of directing fluid from said hydraulic accumulator into an expanding chamber of said hydraulic cylinder during an overrunning load condition.

The object of the present invention is further to provide an inventive hydraulic system where the previously mentioned problem is partly avoided. This object is achieved by the features of the characterising portion of claim 10, wherein the hydraulic system is configured to direct fluid from said hydraulic accumulator into an expanding chamber of said hydraulic cylinder during an overrunning load condition.

The control of hydraulic systems often comprises several different operating modes. The controller is fed with a speed reference signal from the operator for each load. The controller subsequently determines which operating mode to use, and which valves of the hydraulic system to use, such that throttle losses in the system are minimised, and maximal level of energy recovery is obtained.

Some of the operating modes are:

Normal operating mode involves feeding an expanding chamber of a hydraulic actuator with pressurised fluid from the pump and the return oil is fed to the tank.

Recuperative operation mode is applied during an overrunning load where the potential energy of the load should be recovered by another hydraulic device of the hydraulic system. The load itself is the source of motion of the hydraulic actuator and pressurises fluid in a contracting chamber of the hydraulic actuator. The pressurised fluid exciting the hydraulic actuator is for example directed to another load of the system, and/or to an accumulator for storing the energy, and/or to the pump of the hydraulic system, which temporarily will operate as a hydraulic motor. It does not matter if the hydraulic actuator performs a positive stroke or negative stroke, and the potential energy of the load will be recovered.

Energy neutral operation mode is similar to recuperative operation mode and also applied during an overrunning load but without the level of potential energy required to operate another hydraulic actuator of the system, or to save the energy in an accumulator. The load itself is the source of motion of the hydraulic actuator and pressurises fluid in a contracting chamber of the hydraulic actuator. The pressurised fluid of the contracting chamber of the hydraulic actuator is thus simply directed to the tank. It does not matter if the hydraulic actuator performs a positive stroke or negative stroke. Hence, the load will be lowered substantially without the use of additional pump energy.

Regenerative operation mode involves connecting the meter-in and meter-out of the hydraulic actuator. If pressurised fluid is supplied to the interconnected inlet and outlet ports of the hydraulic actuator, the piston will extend due to the difference in cross-sectional area of the rod end and cap end side of the piston in the hydraulic cylinder. The fluid exciting the rod-end chamber will enter the cap-end chamber and thus increase extension speed. An overrunning load in combination with a negative piston stroke will in this mode result in pressurised fluid exciting the contracting cap-end chamber and flow partly to the expanding rod-end chamber and part of the pressurised fluid may be directed to the supply conduit and/or return conduit for recovering the energy thereof. For example, the fluid may be directed to the pump for driving the pump as a hydraulic motor, or the fluid may be directed to the accumulator or to another hydraulic load of the system.

The problem with the recuperative operation mode, energy neutral operation mode, and regenerative operation mode is that hydraulic fluid must in certain situations be supplied to the expanding chamber of the hydraulic actuator for refill thereof. Otherwise, the expanding chamber of the hydraulic actuator will exhibit cavitation and insufficient hydraulic actuator speed, because throttle losses in the hydraulic system prevents refill of the expanding chamber merely by drawing fluid from the tank. A solution to this problem is to refill the expanding chamber of the hydraulic actuator with pressurised fluid from the pump during an overrunning load condition in said recuperative operation mode, energy neutral operation mode, and regenerative operation mode, but this requires operation of the pump and is therefore not energy saving. Furthermore, this solution prevents using the pump as hydraulic motor in a recuperative operation mode. Another solution is to direct pressurised fluid exciting another hydraulic actuator to the expanding chamber of the hydraulic actuator. This solution is however only applicable in certain special circumstances, as it requires simultaneous motion of another hydraulic actuator, as well as sufficient amount of fluid thereof.

The solution according to the invention uses a low pressure accumulator, which is controlled by means of a controller and a suitable valve arrangement to feed the expanding chamber of said hydraulic actuator with pressurised fluid during an overrunning load condition. This can be referred to as a low pressure refill energy recovery mode.

The inventive solution leads to several advantages, such as allowing utilisation of hydraulic system operation modes where refill fluid is otherwise missing, increasing energy saving level by feeding the hydraulic cylinder with fluid from the accumulator instead of using pressurised fluid from the pump, avoiding cylinder cavitation, and increasing speed of hydraulic actuator.

Further advantages are achieved by implementing one or several of the features of the dependent claims. The hydraulic cylinder may be a double acting hydraulic cylinder that comprises a rod end chamber and a cap end chamber, and said fluid from said hydraulic accumulator may be directed into an expanding cap end chamber of said hydraulic cylinder during said overrunning load condition.

The expanding cap end chamber and said rod end chamber may be fluidically connected during said step of directing fluid from said hydraulic accumulator into an expanding chamber of said hydraulic cylinder.

The hydraulic cylinder may be a double acting hydraulic cylinder that comprises a rod end chamber and a cap end chamber, and in that fluid from said hydraulic accumulator is directed into an expanding rod end chamber of said hydraulic cylinder during said overrunning load condition.

The inventive method may additionally involve directing fluid from said pump into said expanding chamber of said hydraulic cylinder during said overrunning load condition, such that a relatively smooth transition from a overrunning load condition to a resistive load condition is obtainable.

The inventive method may additionally involve additionally directing fluid exiting another hydraulic actuator of said hydraulic system into said expanding chamber of said hydraulic cylinder during said overrunning load condition.

The fluid forced out from said hydraulic cylinder may be directed at least partly to said pump for recuperative operation of said hydraulic system.

Charging said hydraulic accumulator may involve directing fluid exiting said hydraulic cylinder or another hydraulic actuator of said hydraulic system into said hydraulic accumulator during an overrunning load condition thereof, and/or directing fluid from said pump into said hydraulic accumulator.

The step of directing fluid from said hydraulic accumulator into an expanding chamber of said hydraulic actuator may further be based on detected fluid pressure within said expanding chamber. Thereby, hydraulic actuator cavitation is reduced or avoided, and reduced amount of fluid delivered by said pump is required.

The hydraulic accumulator may be fluidly connected to said return conduit at an accumulator coupling point, and a counter pressure valve may be arranged at said return conduit between said accumulator coupling point and said tank for regulating the charging pressure of said hydraulic accumulator.

The hydraulic accumulator may be arranged on the tank side of the hydraulic cylinder, in particular between any hydraulic cylinder metering valves of said hydraulic system and said tank.

The hydraulic system may further comprise a first control valve arranged to control the flow of hydraulic fluid between at least said pump and said cap end chamber of the hydraulic cylinder, a second control valve arranged to control the flow of hydraulic fluid between at least said pump and said rod end chamber of the hydraulic cylinder, a third control valve arranged to control the flow of hydraulic fluid between at least said cap end chamber of said hydraulic cylinder and said tank, and a fourth control valve arranged to control the flow of hydraulic fluid between at least said rod end chamber of the hydraulic cylinder and said tank.

The hydraulic system may further comprise a control unit, and in that each of said first, second, third and fourth control valves may be individually controlled by said control unit.

BRIEF DESCRIPTION OF THE DRAWINGS

The present invention will now be described in detail with reference to the figures, wherein.

DETAILED DESCRIPTION

Mobile fluid power systems comprising hydraulic systems are commonly used in working machines, such as excavators, wheel loaders, forest harvester, and the like, and mostly comprises a plurality of hydraulic actuators, a valve arrangement and at least one hydraulic pump. The hydraulic pump is driven by a power source, such as an internal combustion engine. The hydraulic actuators may be hydraulic pistons for operating an arm of an excavator, or a hydraulic motor for propulsion of a vehicle. An electronic control system received control input from an operator of the system, and controls a plurality of hydraulic valves of the valve arrangement, which directs fluid between the systems components. The control unit operates the hydraulic system in different operating modes dependent on the specific situation, load, operator input, etc.

Figure 1:
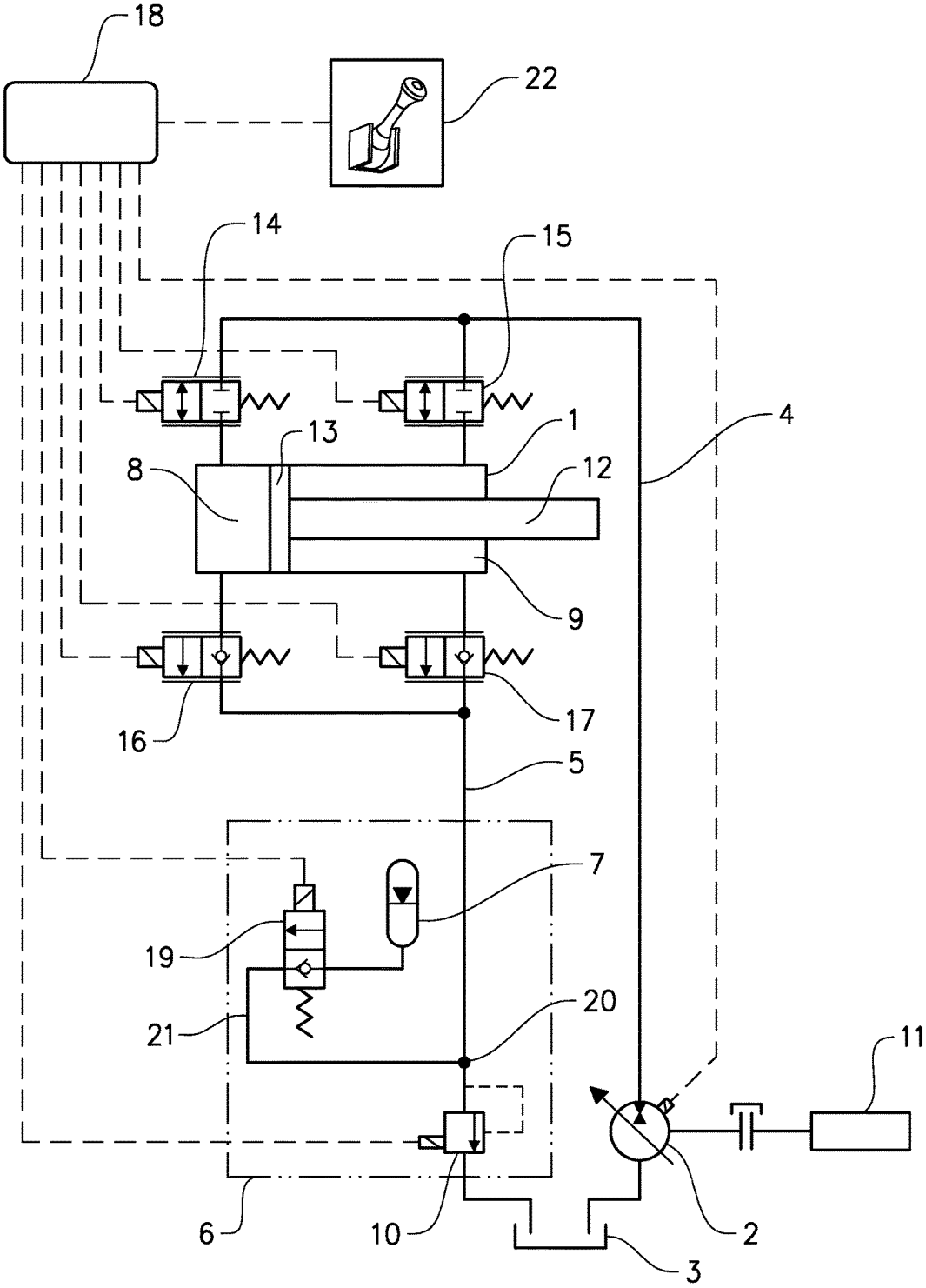
FIG. 1 shows the hydraulic system according to the invention.

The invention will be described in detail with reference to a small part of a hydraulic system for a mobile fluid power system, as illustrated in FIG. 1.

The inventive hydraulic system comprises a hydraulic pump 2 for supplying pressurised hydraulic fluid to a double acting hydraulic cylinder that comprises a rod end chamber 9 and a cap end chamber 8. A sliding rod 12 is attached to a sliding piston 13, which divides a housing of the hydraulic cylinder into said rod end chamber 9 and cap end chamber 8. The pump 2 draws fluid from a tank 3 and feeds pressurised fluid to a supply conduit 4. The pump is driven by a power source 1, such as en internal combustion engine. Only a single hydraulic pump 2 and hydraulic cylinder 1 is illustrated for sake of clarity.

Pressurised fluid from the supply conduit 4 is directed to the cap end chamber 8 via a first control valve 14, and to the rod end chamber 9 via a second control valve 15. Hydraulic fluid exciting the cap end chamber 8 is directed to the tank 3 via a third control valve 16, and hydraulic fluid exciting the rod end chamber 9 is directed to the tank 3 via a fourth control valve 17. Each of said first to fourth control valves 14-17 is individually controlled by a control unit 18, and together they form a so called individual metering system. The control valves 14-17 of the individual metering system may be realised by spool valves or poppet valves, and they are preferably proportionally controlled to allow good position control of the piston 13. The first and second control valves 14, 15 are bi-directional control valves that are proportionally operable in both flow directions. Thereby, the first and second control valves 14, 15 can accurately control the motion and speed of the piston, as well as controlling for example recuperation level during recuperation operating mode. The third and fourth control valves 16, 17 are uni-directional control valves that are proportionally operable in flow direction from the hydraulic cylinder 1 to the tank 3, and acting as check valves in the opposite flow direction.

The hydraulic accumulator 7 is arranged on the tank side of the hydraulic cylinder 1, and fluidly connected to the return conduit 5 at an accumulator coupling point 20 by means of an accumulator conduit 21. Fluid flowing from the hydraulic accumulator 7 to any of the cap end or rod end chambers 8, 9 is proportionally controlled by an accumulator control valve 19 that is arranged on the accumulator conduit 21 connecting the hydraulic accumulator 7 with the return conduit 5. Alternatively, the accumulator may be a simple on-off control valve and the third and fourth control valves 16, 17 may be bi-directional control valves that are proportionally operable in both flow directions.

The energy recovery system 6 comprises except for the hydraulic accumulator 7 and accumulator control valve 19 also a counter pressure valve 10 arranged on the return conduit 5 between the accumulator coupling point 20 and the tank 3. The counter pressure valve 10 controls charging of the hydraulic accumulator 7. The counter pressure valve 10, which raises the fluid pressure in the return conduit 5 and the accumulator conduit 21, is placed at the inlet of the tank 3 The counter pressure valve 10 is preferably pilot operated by means of an electrical signal from the control unit 18, such as to give counter pressure only when a signal is received from the control unit 18.

The control unit 18 is normally configured to, while using as little energy as possible from the pump 2, controlling the valve arrangement of the hydraulic system such that the hydraulic cylinder 1 follows the reference speed given by the operator of the system, for example inputted by means of a joystick 22. The control unit 18 determines, based on system information such as position, speed and acceleration of the hydraulic cylinder 1, and fluid pressure in cap end chamber 8, rod end chamber 9, supply conduit 4, return conduit 5, hydraulic accumulator 7, what operation mode is most suitable for the present situation. Said system information is acquired mainly by means of non-showed sensors positioned at suitable locations in the system. The control unit 18 is further configured to control charging of the hydraulic accumulator 7.

Charging of the hydraulic accumulator 7 is primarily performed by directing pressurised fluid into the accumulator 7 that would otherwise have been directed to the tank 3. This type of charging thus falls under energy recovery charging. Directing pressurised fluid into the accumulator is realised by limiting flow through the counter pressure valve 10, thus leading to increased fluid pressure at accumulator coupling point 20. As soon as the fluid pressure at the accumulator coupling point 20 exceeds the fluid pressure within the accumulator 7, the check valve of the accumulator control valve opens and fluid is directed into the accumulator 7. Should the control unit 18 subsequently detect that the hydraulic cylinder 1 risk no longer being able to follow the reference speed of the hydraulic accumulator 1 set by the operator, then the flow through the counter pressure valve 10 is allowed to increase. In general however, first, second, third and fourth control valves 14, 15, 16, 17 determine the motion of the hydraulic cylinder 1, in combination with the pump 2. Pressurised fluid exciting the hydraulic cylinder 1 may be occur in several different operation modes and cylinder modes, during for example an overrunning load condition or an inertial load condition. Charging of the accumulator 7 may also occur when the pump displacement is not variable to an extent required by the control unit 18 and pressurised fluid from the pump otherwise would have been directed to the tank 3. A non-illustrated additional pump-accumulator-conduit could for example be included in the system for the purpose of direct charging of the accumulator 7. Charging of the accumulator 7 may also be performed by feeding pressurised fluid to the accumulator 7 exciting other hydraulic actuators of the hydraulic system, such as other hydraulic cylinders or hydraulic motors.

Below, the energy recovery method for a hydraulic system will be explained in detail with reference to a few exemplary specific operation situations. Operation of the low pressure refill energy recovery mode according to the invention is particularly advantageous in the following three cylinder modes:

1. Recuperative operation mode in combination with a positive piston stroke, wherein the expanding cap-end chamber 8 is refilled by means of fluid from the accumulator 7.
2. Recuperative operation mode in combination with a negative piston stroke, wherein the expanding rod-end chamber 9 is refilled by means of fluid from the accumulator 7.
3. Regenerative operation mode in combination with a positive piston stroke, wherein the expanding cap-end chamber 9 is refilled by means of fluid from the accumulator 7.

In the first cylinder mode described above, potential energy of the load and moving machine equipment is recovered and transmitted to other hydraulic consumers of the hydraulic system, or used to operate the pump 2 as hydraulic motor. The fluid required to refill the expanding cap-end chamber 8 of the hydraulic cylinder is taken at least partly from the hydraulic accumulator 7, and the present cylinder mode is thus realisable as soon the accumulator 7 is sufficiently charged. No pressurised fluid is required from the pump 2.

The second cylinder mode described above is similar to the first cylinder mode, and potential energy of the load and moving machine equipment is also here recovered and transmitted to other hydraulic consumers of the hydraulic system, or used to operate the pump 1 as hydraulic motor. The fluid required to refill the expanding rod-end chamber 9 of the hydraulic cylinder 1 is taken at least partly from the hydraulic accumulator 7, and the present cylinder mode is thus realisable as soon the accumulator 7 is sufficiently charged. No pressurised fluid is required from the pump 2.

The third cylinder mode uses fluid at least partly from the low pressure accumulator 7 for refill of the expanding cap-end chamber 8. Additional refill fluid is required during this cylinder more due to the difference in cross-sectional area of the rod end and cap end side of the piston 13 in the hydraulic cylinder 1, whereby the amount of fluid expelled from the rod-end chamber 9 is not sufficient for completely refilling the expanding cap-end chamber 8. Without refill fluid from the accumulator 7, fluid would have been required from other sources, such as the pump 2, or other hydraulic actuators of the hydraulic system that are simultaneously moving and able to provide the necessary refill fluid. No substantial amount of pressurised fluid is required from the pump 2.

Operation of the low pressure refill energy recovery mode according to the invention is particularly advantageous in the above described three cylinder modes, but the low pressure refill energy recovery mode is advantageous also in other cylinder modes. For example, refill of the expanding chamber is equally required in the neutral operation mode, and due to the invention, said refill may be accomplished by means of fluid from accumulator 7 instead of fluid from the pump 2 or other non-reliable fluid sources.

The hydraulic system is configured to use the hydraulic accumulator 7 for storing hydraulic fluid for refill purpose. Since the fluid of the accumulator 7 is not adapted to be the sole or supplemental power source for powered extension and retraction of a hydraulic cylinder, there is no need to store high pressure fluid within the accumulator. Hence, only low pressure fluid will be stored in the accumulator 7. For example, the accumulator 7 may typically be adapted to store hydraulic fluid having a fluid pressure between 0-50 bar, preferably 0-30 bar. This can be compared with a fluid pressure of around 300 bar for hydraulic accumulators arranged on the pump side of the hydraulic actuators, i.e. the fluid high potential side, and which are adapted to be used for powered extension and retraction of the hydraulic accumulators.

Figure 2:
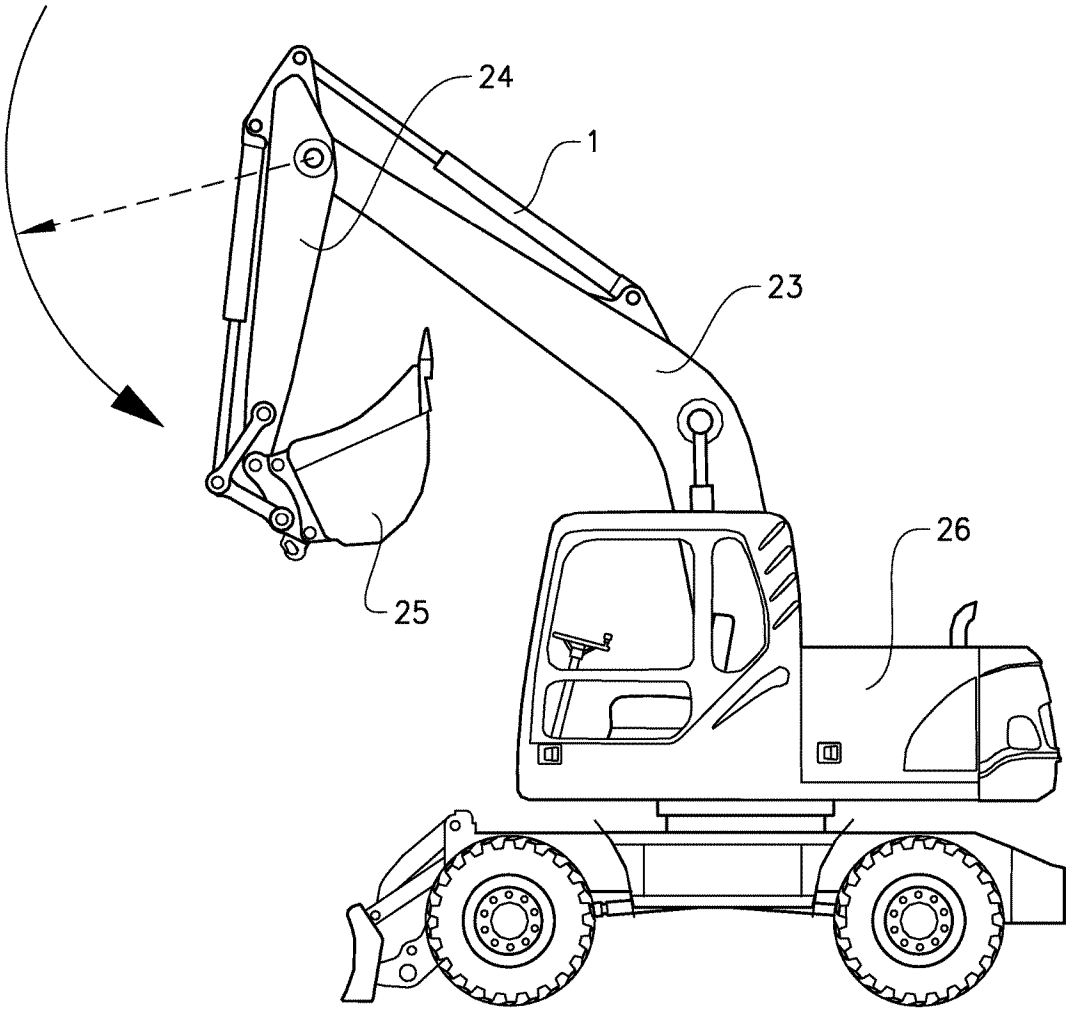
FIG. 2 shows an excavator performing a motion.

The control unit 18 will frequently change between the different operating modes during operation of the hydraulic system. For example, in a typical modern excavator application of the invention as illustrated in FIG. 2, a hydraulically operated boom assembly comprising a boom 23 pivotally attached to the house 26 of the vehicle, a stick 24 pivotally attached to the boom 23, and a bucket 25 pivotally attached to the stick 24. In a situation where the hydraulic cylinder 1 is associated with the stick 24 of the boom assembly, and where the stick 24 starts a motion from a near horizontal orientation, pivots downwards as indicated by the arrow in FIG. 2 in an overrunning load condition to reach a vertical orientation, and then continues the same motion in a resistive load condition to reach a final position where the stick 24 has an inclined configuration again, the control unit 18 may for example select to initially operate the hydraulic system in a recuperative or regenerative operation mode during lowering of the load for the purpose of recovering the potential energy of the load in the bucket 25 and stick 24. Upon approaching the vertical orientation of the stick 24, the control unit 18 may select the neutral operation mode due to the reduced level of potential energy available, and when the speed of the stick 24 risks falling below the speed reference set by the operator, the control unit 18 will select the normal operation mode to keep the required speed and subsequently to raise the load again as the stick 24 passes the vertical position and approaches the house 26 of the excavator. Without refill fluid from the accumulator 7, neither the recuperative nor the regenerative operation modes would have been possible, and pressurised fluid from the pump 2 would have been required for refill purpose, given that no refill fluid was available from another fluid actuator.

During the initial motion from the horizontal orientation to the near vertical orientation, fluid from the accumulator 7 is directed to the expanding cap end chamber 8 of the hydraulic cylinder 1 associated with the motion of the stick 24 for the purpose of refilling said chamber 8. At a certain time instant, a transition from the overrunning load condition to the resistive load condition is required. For the purpose of providing a relatively smooth transition from said overrunning load condition to said resistive load condition, a small amount of fluid may during certain advantageous operation modes be directed from said pump 2 into said expanding chamber 8 of said hydraulic cylinder 1 already during said overrunning load condition, in addition to the fluid from the accumulator 7. Since the first and second control valves 14, 15 are proportionally controlled, it is easy to control the level of fluid supply from the pump 2. The hydraulic system is however normally configured to supply the main part of the fluid from the accumulator 7 and only a small part from the pump 2 for the purpose of accomplishing high energy recovery level.

Figure 3:
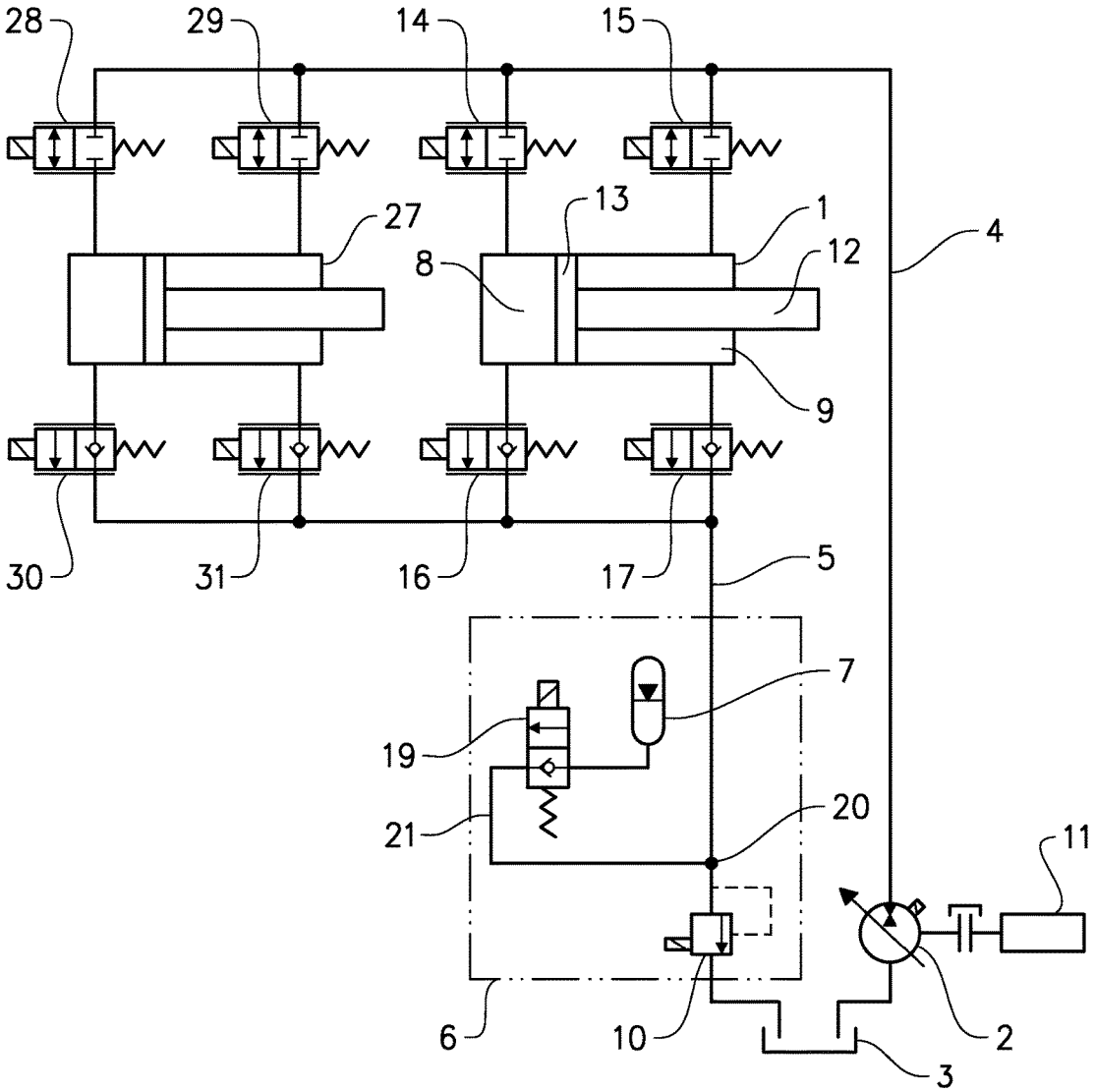
FIG. 3 shows the inventive hydraulic system of FIG. 1 including another hydraulic actuator.

FIG. 3 schematically illustrates the inventive energy recovery method and system of FIG. 1 but here schematically including also another hydraulic actuator 27 in form of a double acting hydraulic cylinder, which is connected in parallel with the hydraulic cylinder 1. The hydraulic system may of course include many more non-illustrated hydraulic actuators, which are fluidly connected to the pump 2 and hydraulic accumulator 7. Note also that the control unit 18, joystick 22 and associated control lines are not illustrated in FIG. 3. The cap and rod end chambers of the other hydraulic actuator 27 are preferably connected to the pump 2 via a fifth and sixth control valve 28, 29 respectively, and cap and rod end chambers of the other hydraulic actuator 27 are preferably connected to the tank 3 and hydraulic accumulator 7 via the seventh and eight control valves 30, 31 respectively. The fifth and sixth control valves 28, 29 being essentially identical to the first and second control valves 14, 15, and seventh and eight control valves 30, 31 being essentially identical to the third and fourth control valves 16, 17. It is clear from the FIGS. 1 and 3 that the energy recovery system 6 including the hydraulic accumulator 7 is arranged on the fluid low potential side of the hydraulic system, close to the tank 3. Hence, fluid exciting the hydraulic cylinder 1 or the other hydraulic actuator 27 may be directed to the hydraulic accumulator via said third, fourth, seventh or eight control valves 16, 17, 30, 31 for charging said accumulator 7, and fluid may be discharged from the hydraulic accumulator 7 and supplied to the hydraulic cylinder 1 and/or other hydraulic actuator 27 for refill purpose via said third, fourth, seventh or eight control valves 16, 17, 30, 31. Said third, fourth, seventh or eight control valves 16, 17, 30, 31 are thus arranged between the hydraulic actuators and the energy recovery system 6.

The term other hydraulic actuator as used herein, generically refers to any device, such as a cylinder-piston arrangement or a rotational motor for example, that converts hydraulic fluid flow into mechanical motion, and oppositely.

The term resistive load is considered to define a load that opposes the direction of motion of the actuator. The direction of the load reaction is opposite of the direction of motion of the actuator, or a component of the direction of motion.

The term overrunning load, sometimes called a negative load, is considered to define a load that has the same direction as the motion of the actuator, or a component of the direction of motion.

The term inertial load is considered to define a load in which the load reaction on the actuator is essentially characterized by Newton's Second Law of Motion.

Reference signs mentioned in the claims should not be seen as limiting the extent of the matter protected by the claims, and their sole function is to make claims easier to understand. As will be realised, the invention is capable of modification in various obvious respects, all without departing from the scope of the appended claims. Accordingly, the drawings and the description thereto are to be regarded as illustrative in nature, and not restrictive.

TABLE OF REFERENCE SIGNS

1 Hydraulic cylinder
2 Pump
3 Tank
4 Supply conduit
5 Return conduit
6 Energy recovery system
7 Hydraulic accumulator
8 Cap end chamber
9 Rod end chamber
10 Counter pressure valve
11 Power source
12 Sliding rod
13 Piston
14 First control valve
15 Second control valve
16 Third control valve
17 Fourth control valve
18 Control unit
19 Accumulator control valve
20 Accumulator coupling point
21 Accumulator conduit
22 Joystick
23 Boom
24 Stick
25 Bucket
26 House
27 Another hydraulic actuator
28 Fifth control valve
29 Sixth control valve
30 Seventh control valve
31 Eight control valve

The invention claimed is:

1. An energy recovery method for a hydraulic system comprising a hydraulic cylinder, a pump for supplying pressurized fluid to the hydraulic actuator, a tank, a supply conduit, a return conduit, and a hydraulic accumulator that is fluidly connected to said return conduit at an accumulator coupling point, the method comprising the steps of:

charging said hydraulic accumulator, storing fluid in said hydraulic accumulator, directing, independently of the pump, fluid from said hydraulic accumulator into an expanding chamber of said hydraulic cylinder during an overrunning load condition, and controlling the flow of fluid from said hydraulic accumulator into said expanding chamber by an accumulator control valve that is controlled by an electronic control unit, wherein said step of charging said hydraulic accumulator includes regulating the charging pressure of said hydraulic accumulator by using a counter pressure valve that is controlled by the electronic control unit and arranged at said return conduit between said accumulator coupling point and said tank.

2. The method according to claim 1, wherein said hydraulic cylinder is a double acting hydraulic cylinder that comprises a rod end chamber and a cap end chamber, and wherein said fluid from said hydraulic accumulator is directed into an expanding cap end chamber of said hydraulic cylinder during said overrunning load condition.

3. The method according to claim 2, wherein said expanding cap end chamber and said rod end chamber are fluidically connected during said step of directing fluid from said hydraulic accumulator into an expanding chamber of said hydraulic cylinder.

4. The method according to claim 1, wherein said hydraulic cylinder is a double acting hydraulic cylinder that comprises a rod end chamber and a cap end chamber, and wherein fluid from said hydraulic accumulator is directed into an expanding rod end chamber of said hydraulic cylinder during said overrunning load condition.

5. The method according to claim 1, further comprising the step of directing fluid from said pump into said expanding chamber of said hydraulic cylinder during said overrunning load condition, such that a relatively smooth transition from an overrunning load condition to a resistive load condition is obtainable.

6. The method according to claim 1, further comprising the step of directing fluid exiting another hydraulic actuator of said hydraulic system into said expanding chamber of said hydraulic cylinder during said overrunning load condition.

7. The method according to claim 1, further comprising the step of directing at least a portion of said fluid forced out from said hydraulic cylinder to said pump for recuperative operation of said hydraulic system.

8. The method according to claim 1, wherein said step of charging said hydraulic accumulator involves directing fluid exiting said hydraulic cylinder or another hydraulic actuator of said hydraulic system into said hydraulic accumulator during an overrunning load condition.

9. The method according to claim 1, wherein said step of charging said hydraulic accumulator involves directing fluid from said pump into said hydraulic accumulator.

10. A hydraulic system comprising a hydraulic cylinder, a pump configured to supply fluid to at least said hydraulic cylinder, a tank, a supply conduit connecting said pump and said hydraulic cylinder, a return conduit connecting said hydraulic cylinder and said tank, and a hydraulic accumulator, wherein said hydraulic system is configured to direct, independently of the pump, fluid from said hydraulic accumulator into an expanding chamber of said hydraulic cylinder during an overrunning load condition, wherein the flow of fluid from said hydraulic accumulator into said expanding chamber is controlled by an accumulator control valve, wherein said hydraulic accumulator is fluidly connected to said return conduit at an accumulator coupling point, wherein a counter pressure valve is arranged at said return conduit between said accumulator coupling point and said tank for regulating the charging pressure of said accumulator, and wherein both the accumulator control valve and counter pressure valve are controlled by an electronic control unit.

11. A hydraulic system according to claim 10, wherein said hydraulic cylinder is a double acting hydraulic cylinder that comprises a rod end chamber and a cap end chamber, and wherein said hydraulic system is configured to direct fluid from said hydraulic accumulator into an expanding cap end chamber or expanding rod end chamber of said hydraulic cylinder during said overrunning load condition.

12. A hydraulic system according to claim 10, wherein said hydraulic accumulator is arranged on the tank side of the hydraulic cylinder.

13. A hydraulic system according to claim 12, wherein said hydraulic accumulator is arranged on the tank side of the hydraulic cylinder between at least one hydraulic cylinder metering valve of said hydraulic system and said tank.

14. A hydraulic system according to claim 10, further comprising a first control valve arranged to control the flow of hydraulic fluid between at least said pump and said cap end chamber of the hydraulic cylinder, a second control valve arranged to control the flow of hydraulic fluid between at least said pump and said rod end chamber of the hydraulic cylinder, a third control valve arranged to control the flow of hydraulic fluid between at least said cap end chamber of said hydraulic cylinder and said tank, and a fourth control valve arranged to control the flow of hydraulic fluid between at least said rod end chamber of the hydraulic cylinder and said tank.

15. A hydraulic system according to claim 14, further comprising a control unit, and in that each of said first, second, third and fourth control valves is individually controlled by said electronic control unit.

* * * * *